US008602465B2

(12) United States Patent
Holmgren

(10) Patent No.: US 8,602,465 B2
(45) Date of Patent: Dec. 10, 2013

(54) LOCKING DEVICE

(75) Inventor: Anders Holmgren, Stockholm (SE)

(73) Assignee: Optosolutions Sweden AB (SE)

( * ) Notice: Subject to any disclaimer, the term of this patent is extended or adjusted under 35 U.S.C. 154(b) by 1116 days.

(21) Appl. No.: 12/308,157

(22) PCT Filed: May 30, 2007

(86) PCT No.: PCT/SE2007/050370

§ 371 (c)(1),
(2), (4) Date: Sep. 9, 2009

(87) PCT Pub. No.: WO2007/142595

PCT Pub. Date: Dec. 13, 2007

(65) Prior Publication Data

US 2010/0045054 A1 Feb. 25, 2010

(30) Foreign Application Priority Data

Jun. 2, 2006 (SE) ..... 0601269-4

(51) Int. Cl.
*E05C 17/58* (2006.01)

(52) U.S. Cl.
USPC ..... 292/251.5

(58) Field of Classification Search
USPC ..... 292/251.5
See application file for complete search history.

(56) References Cited

U.S. PATENT DOCUMENTS

| | | | | |
|---|---|---|---|---|
| 3,641,793 A | | 2/1972 | Van Dalen | |
| 3,744,833 A | * | 7/1973 | Berducone | 292/251.5 |
| 4,848,812 A | | 7/1989 | Slaughter | |
| 4,950,842 A | | 8/1990 | Menninga | |
| 5,076,623 A | | 12/1991 | Richards | |
| 5,184,405 A | | 2/1993 | Cress | |
| 5,485,733 A | * | 1/1996 | Hoffman | 70/276 |
| 6,000,735 A | | 12/1999 | Jourdenais | |
| 6,336,567 B1 | * | 1/2002 | Hyobu | 220/230 |
| 6,588,811 B1 | * | 7/2003 | Ferguson | 292/251.5 |
| 6,656,278 B2 | * | 12/2003 | Baisch | 118/500 |
| 6,659,516 B2 | * | 12/2003 | Wang et al. | 292/251.5 |
| 7,234,739 B2 | * | 6/2007 | Saitoh et al. | 292/251.5 |

FOREIGN PATENT DOCUMENTS

| | | |
|---|---|---|
| GB | 2 405 445 A | 3/2005 |
| WO | WO-97/18371 A1 | 5/1997 |

* cited by examiner

*Primary Examiner* — Kristina Fulton
(74) *Attorney, Agent, or Firm* — Lerner, David, Littenberg, Krumholz & Mentlik, LLP

(57) ABSTRACT

The invention relates to a locking device comprising a first and a second locking part (2, 4), wherein the second locking part (4), when the locking parts (2, 4) are brought together, moves in relation to the first locking part (2) in a locking direction (L). The first locking part (2) comprises a locking member (2*b*), comprising a magnet, and a locking member holder (2*a*), which supports the locking member (2*b*) without the locking member (2*b*) being fixed to the locking member holder (2*a*). The second locking part (4) comprises an actuating part (4*b*), the locking member (2*b*) comprises a contact part (2*y*). Once the actuating part (4*b*), when moving in the locking direction (L), has passed the contact part (2*y*), the contact part (2*y*) moves into the path of the actuating part (4*b*), so that the locking member (2*b*), through bearing contact against the locking member holder (2*a*) and against the actuating part (4*b*), can prevent movement of the second locking part (4) in a direction opposite to the locking direction (L). When a force generated by a magnetic field is acted upon by the magnet, the contact part (2*y*) moves out of the path of the actuating part (4*b*).

9 Claims, 14 Drawing Sheets

LOCKING DEVICE

TECHNICAL FIELD

The present invention relates to a locking device comprising a first and a second locking part, which are arranged, in a fitted state of the locking device, to be fixedly connected to a first and a second element respectively, wherein the second locking part, when the locking parts are brought together, moves in relation to the first locking part in a locking direction, and wherein the first locking part comprises a locking member comprising a temporary magnet or a permanent magnet.

BACKGROUND

Locking devices which are controllable by means of magnetism are known and have been proposed in connection with the design of childproof locks. The locking device can be disposed on the inside of a cupboard door or kitchen drawer, which is unlocked by a "key" with a permanent magnet being brought against the outside the door or drawer for unlocking by a movement in the locking device induced by a magnetic-field-generated force between the "key" and the locking device.

As examples of known solutions, patent specifications U.S. Pat. No. 5,184,405, U.S. Pat. No. 5,076,623, U.S. Pat. No. 6,000,735 and U.S. Pat. No. 5,485,733 can be cited, which describe locking devices having a bolt which is pivotable about an axis, and U.S. Pat. No. 3,744,833, U.S. Pat. No. 3,641,793, U.S. Pat. No. 4,950,842 and U.S. Pat. No. 4,848,812, which describe sliding bolts which are detained in the locking and non-locking position, respectively, with the aid of magnetic or spring force.

A drawback with known solutions having magnetic locking-function control is that they are relatively complicated, comprising a large number of integral structural elements, which makes their production process and fitting in a cupboard, etc. relatively complicated and which implies, moreover, a risk of rapid wear during use.

SUMMARY

An object of the present invention is to provide a magnetically controllable locking device which has a secure locking function and is simple to produce.

A further object of the invention is to provide a magnetically controllable locking device which has a secure locking function and is wear-resistant.

Another object of the invention is to provide a magnetically controllable locking device which has a secure locking function and is easy to fit.

These objects are achieved with a locking device of the type defined in the introduction, characterized in that the first locking part comprises a locking member holder, which is arranged to support the locking member without the locking member being fixed to the locking member holder, the locking member being movable in relation to the locking member holder, in that the second locking part comprises an actuating part, the locking member comprises a contact part, and the locking device is arranged such that, in the fitted state of the locking device, the movement of the contact part out of or into the path of the actuating part is corresponded to by an at least partially upward and an at least partially downward movement, respectively, of the centre of gravity of the locking member, in that the locking device is arranged such that, in the fitted state of the locking device, and once the actuating part, when moving in the locking direction, has passed the contact part, the contact part moves into the path of the actuating part, so that the locking member, through bearing contact against the locking member holder and against the actuating part, can prevent movement of the second locking part in a direction opposite to the locking direction, and in that the locking device is arranged such that, when the locking device is in the fitted state and when a force generated by a magnetic field is acted upon by the temporary or permanent magnet, the contact part moves out of the path of the actuating part.

The elements can be mutually interacting elements, for example a cupboard and a door for the cupboard, the locking device being suitable for locking of the elements in a closed position in relation to one another, for example a position which is closed for the door.

For the following representation, the terms locking position of the locking member, in which the contact part is in the path of the actuating part, and opening position of the locking member, in which the contact part is outside the path of the actuating part, are introduced. The centre of gravity of the locking member is in the opening position in a higher position than in the locking position.

By permanent magnet is meant an element which retains its magnetism in the absence of any external magnetic field, and by a temporary magnet is meant an element which is magnetized under the influence of an external magnetic field, but which loses its magnetism when the external magnetic field is removed. A permanent magnet can be made of any suitable material such as sintered neodymium-iron-boron (NdFeB), alnico, nipermag, chromium steel, tungsten steel, or any other suitable steel alloy. A temporary magnet can be made of any suitable material such as permalloy, siliceous steel or soft iron.

The fact that the locking member is supported by the locking member holder without being fixed to the latter means that the locking member is trapped or enclosed, without fixed or hinged fastening to the locking member holder, and without being otherwise connected to the locking member holder, for example via springs, etc. Hence the locking member, solely as a result of its external shape and the internal shape of the locking member holder, is limited to a movement which is substantially parallel with a vertical plane lying parallel with the locking direction, which offers an opportunity to provide the first locking part as a very simple construction comprising just two parts, with simple shapes and simple interaction. Given suitable choices of material, apart from negligible friction losses between the surfaces of the locking member and locking member holder, the movement of the locking member is substantially frictionless even after long use, unlike solutions involving joints or axles, which, after a period of wear, can begin to "seize up". Moreover, solutions of the latter type involve a large number of structural parts having to be provided.

The fact that the locking member, through bearing contact against the locking member holder and against the actuating part, prevents movement of the second locking part in a direction opposite to the locking direction means that the locking member, through bearing contact in a first contact region against the locking member holder and bearing contact in a second contact region against the actuating part, which second contact region lies farther away in the locking direction than the first contact region, prevents movement of the second locking part in a direction opposite to the locking direction.

The invention means that a movement of the contact part out of and into the path, parallel with the locking direction, of the actuating part is corresponded to by an at least partially upwardly directed and an at least partially downwardly directed movement, respectively, of the centre of gravity of the locking member, which, in combination with the low friction between the locking member and the locking member holder, means that the locking position can be assumed and maintained solely with the aid of gravitational force, without any other aids such as a spring or a magnetic force. In particular, no additional permanent or temporary magnet is needed to force the locking member towards the locking position. In greater detail, as exemplified below with reference to FIG. 3 (#4*f*, 4*g*), the actuating part preferably has a first surface region and a second surface region, the first surface region, in the fitted state of the locking device and when the second locking part is close to the first locking part, is situated, in relation to the second surface region, farther away in the locking direction and farther away in a direction parallel with the movement of the contact part out of the path of the actuating part, which means that the contact path, once the first surface region in the locking direction has passed the contact part, moves into the path of the actuating part and the locking member assumes the locking position. In a locking manoeuvre, therefore, the first surface region is able to move past the contact part, whereupon the actuating part comes into contact with the contact part so that the centre of gravity of the locking member is displaced at least partially upwards, whereafter the locking member, once the first surface region has passed the contact part, owing to the gravitational influence, is able once again to move towards the locking position. As is described in greater detail below, the locking member, in the locking position induced by the gravitational force, through bearing contact against the locking member holder and the actuating part, can prevent the locking parts from moving away from each other.

The simple gravitational steering towards the locking position means that the force generated by the magnetic field, here also referred to as the magnetic force, through suitable configuration of the locking member and its holder, can in principle be directed in whichever direction, apart from downwards, which provides great flexibility of design and adaptation of the locking member to different types of elements to be locked together.

In the locking position, the locking member, as has been mentioned, through bearing contact against the locking member holder and the second locking part, can block the movement of the second locking part. It should be pointed out that, during the actual blocking, i.e. in a loaded locking position, here also referred to as the blocking position, the position of the locking member, as is shown in greater detail below with reference to FIGS. 3*a* and 4, can differ somewhat from the unloaded locking position. Since the locking member, in the locking position, is arranged to assume a blocking position in which it in a first contact region bears against the locking member holder, to be more precise against at least one surface in the locking member holder, and in a second contact region bears against the actuating part, which second contact region lies farther away in the locking direction than the first contact region, the locking force increases when the second locking part is subjected to a force in a direction opposite to the locking direction, for example induced by a person pulling the element to which the second locking part is fixed. In other words, the locking member lies wedged between the actuating part and the locking member holder and an increased force upon the second locking part in a direction opposite to the locking direction increases the clamping force upon the locking member. This means that a secure locking is obtained.

The locking device according to the invention thus offers a simple, secure and wear-resistant solution for locking two mutually interacting elements, for example a cupboard and a door for the cupboard, in a closed position in relation to one another, for example a position which is closed for the door.

The locking direction, at least when the second locking part is close to the first locking part, can be substantially horizontal, the actuating part being arranged to move beneath at least a part of the locking member, preferably beneath the centre of gravity of the locking member. Moreover, the locking member can be elongated, preferably substantially parallelepipedal, the first locking part being arranged such that the locking member, when the contact part (2*y*) is positioned in the path of the actuating part (4*b*), is inclined, which inclination is preferably directed downwards in the locking direction. Such a simple shape of the locking member facilitates the production of the locking device. In a preferred embodiment, the locking member is provided in the form of a parallelepipedal elongated permanent magnet. A permanent magnet of this kind is commercially available and this solution therefore offers a very simple and wear-resistant construction. Alternative shapes for the magnet are, of course, possible; for example, it can be elongated with square, round or other cross-sectional shape, and can have end faces which are perpendicular or angled (bevelled) to the longitudinal axis.

Preferably, the first locking part has at least one supporting surface, which at least partially slopes downwards in the locking direction, the locking member being arranged, when the contact part is positioned in the path of the actuating part under the influence of solely gravitational force, to be supported by the supporting surface. According to a preferred embodiment, the locking member is arranged, when the locking device is in the fitted state and when a force generated by a magnetic field is acted upon by the temporary or permanent magnet, to bear against a substantially vertical first inner surface, substantially perpendicular to the locking direction, in the locking member holder.

Preferably, as is exemplified below with reference to FIG. 4, the second locking part comprises an engagement member comprising the actuating part, which engagement member is elongated in the locking direction, and the locking device is arranged such that, if the movement of the second locking part in a direction opposite to the locking direction is prevented, the locking member holder, through contact with the engagement member, prevents or limits the bending of the engagement member in a direction away from the bearing contact of the locking member against the locking member holder. This enables a compact configuration of the locking device, in which the engagement part can slide into the locking member holder to engage with the locking member and, moreover, in the event of an opening attempt, prevents the engagement member from being bent such that the locking member "slips off" the engagement member and disengages. This means, in turn, that the flexural rigidity of the engagement member can be relatively low, thereby implying both material and space savings.

DESCRIPTION OF THE FIGURES

The invention will be described in greater detail below with reference to the drawings, in which.

DETAILED DESCRIPTION

Figure 1:
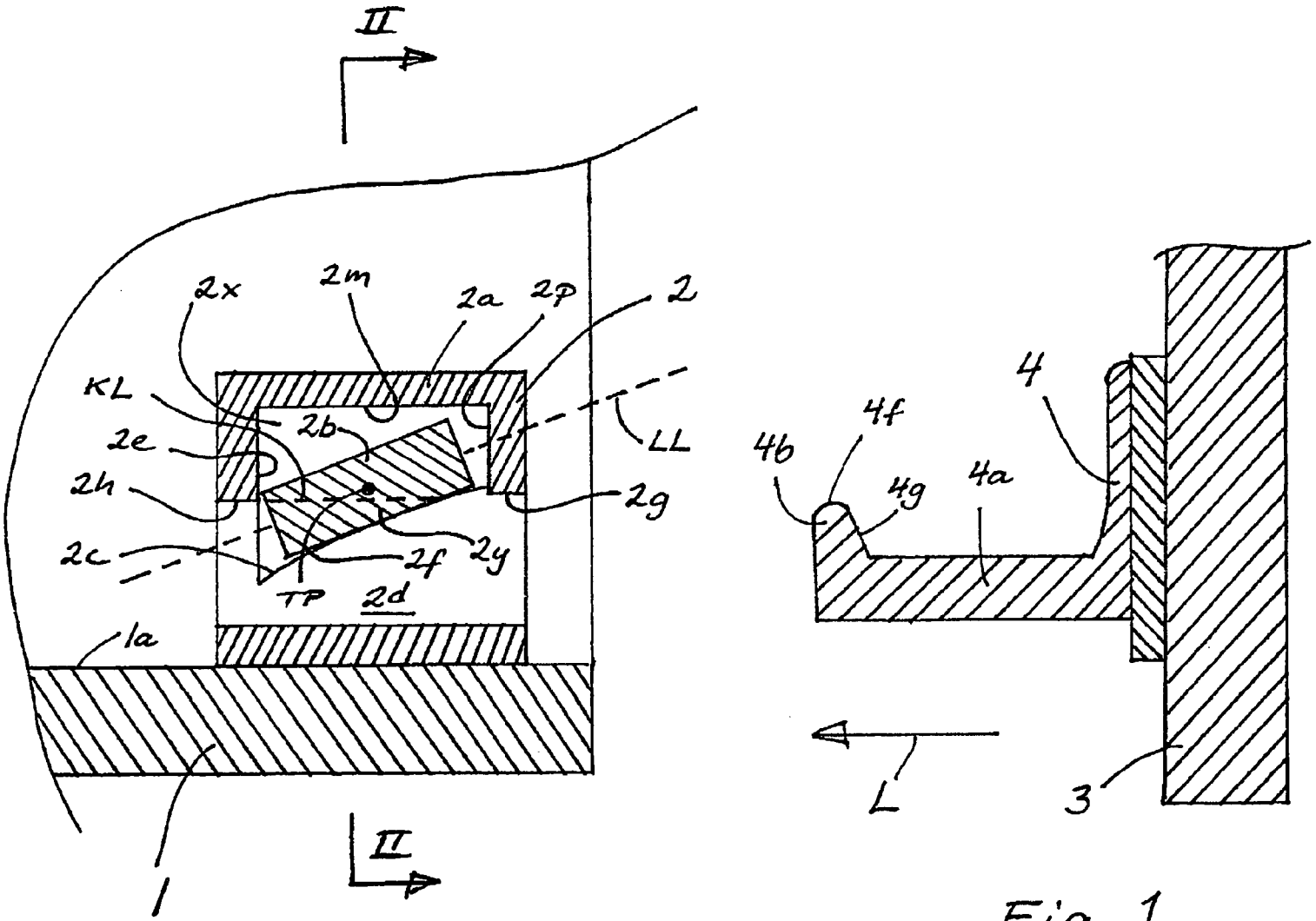
FIG. 1 shows a cross-sectional view of a locking device according to one embodiment of the invention, fitted in a cupboard and on a door for the cupboard.

FIG. 1 shows a cross-sectional view of a part of a first element 1, in the form of a cupboard, a lower part of a second element 3, interacting with the first element 1, in the form of a door 3 for the cupboard 1, and a locking device comprising a first locking part 2 and a second locking part 4. The second locking part 4 is preferably made of a non-magnetic material, i.e. it is neither a permanent nor a temporary magnet.

The first locking part 2 and the second locking part 4 are fixedly connected to the first element 1 and the second element 3 respectively. The respective locking parts 2, 4 are preferably fastened by means of a suitable tape, for example one such which is marketed under the name 3M VHB tape. Alternatively, second fastening means can be used, such as screws, glue, rivet, etc. Where screws, rivets, etc. are used, these are preferably made of a non-magnetic material, i.e. they form neither a temporary nor a permanent magnet. In the event of an attempt, in the locked position of the locking device, to pull the elements 1, 3 apart, as a result of the position for the engagement between the locking parts (see FIG. 4 below), a load arises in a part of the fixing surface of the first locking part 2, which load tends to rip the first locking part 2 off from the first element 1. In an advantageous alternative variant of the invention, the bottom surface 2*t* of the locking member holder 2*a* therefore has a longer extent in the locking direction L than is shown in FIG. 1. For example, a lower part of the locking member holder 2*a* can be extended leftwards in FIG. 1, so that a larger fixing surface is produced between the first locking part 2 and the first element 1.

In FIG. 1, the first locking part 2 is shown fixed to an upward-facing inner surface 1*a* very low down in the cupboard 1, but alternative positionings are possible, for example on a vertical side surface, or a downward-facing surface in the cupboard, tape, for example of the type described above, being able to be applied to a side surface and top surface respectively of the first locking part 2. Of course, a variety of positions in the cupboard are also conceivable for the first locking part, for example on a fixed shelf higher up than is shown in FIG. 1. The elements 1, 3 can alternatively be other types of interacting objects, for example a chest of drawers and a pull-out drawer therein.

In a locking manoeuvre which results in the locking parts being locked together, the second locking part 4 moves in relation to the first locking part 2 in a locking direction, indicated in FIG. 1 with the arrow L. The locking direction L is in this example substantially horizontal, at least when the second locking part 4 is close to the first locking part 2. For this representation, what is meant by the movement of the second locking part 4 in the locking direction L is a relative movement vis-à-vis the first locking part 2. This means that, in an alternative embodiment in which the first locking part 2 is fixed to a movable element, such as a door, and the second locking part 4 is fixed to a fixed element, such as a cupboard, in this representation the second locking part 4, in a locking manoeuvre, is deemed to move in relation to the first locking part 2 in a locking direction. It should also be pointed out that the locking direction L in certain applications, for example when the second locking part is fitted to a door and, in a locking manoeuvre, follows a part-circular path, is dependent on the position of the second locking part 4 (i.e. the door). However, in order to facilitate an understanding of this representation, the locking direction L may be regarded as the movement of the second locking part 4 in relation to the first locking part when the locking parts 2, 4 are close together. The locking direction L may here be regarded as independent of the position of the second locking part 4, since the mutual relative movement of the first and the second locking part 2, 4 can then be deemed to be approximately straight. In a practical case in which the locking parts 2, 4 are fitted to a cupboard and a door for the cupboard respectively, this can be considered to be the case when the door has an opening angle of less than 5 degrees.

The first locking part 2 comprises a locking member holder 2*a*, which is preferably made of a non-magnetic material. The locking member holder 2*a* encloses a locking member 2*b* in the form of a permanent magnet 2*b* having a somewhat elongated parallelepipedal shape.

Figure 2:
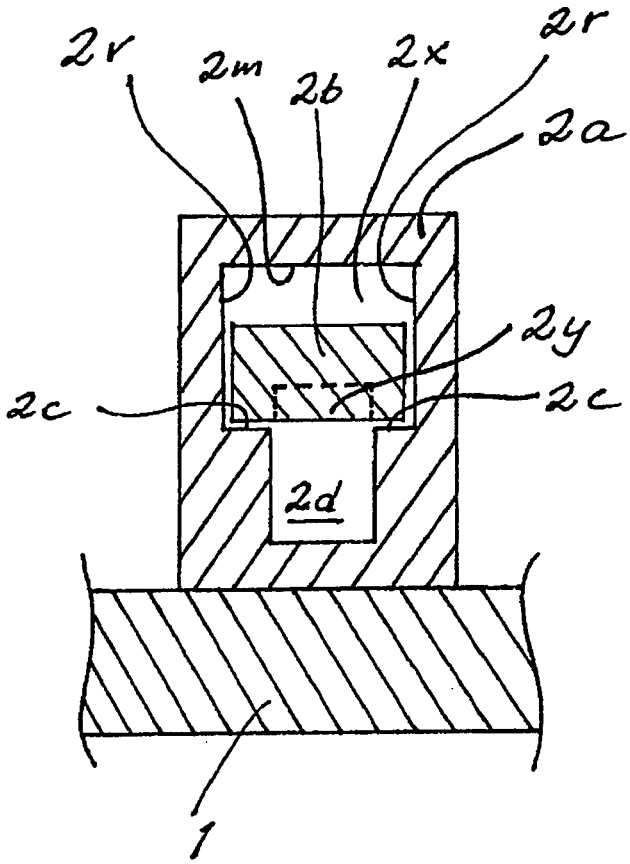
FIG. 2 shows a cross-sectional view with the section placed along the line II-II in FIG. 1, FIGS. 2*a* and 2*b* show respectively a perspective view obliquely from above and a perspective view obliquely from below of the respective parts of the locking device in FIG. 1, FIGS. 3, 3*a* and 4 show cross-sectional views corresponding to that in FIG. 1.

The locking member holder 2*a* comprises two supporting surfaces 2*c*, in the form of cams 2*c*, visible also in FIG. 2 in which the locking direction L is out of the plane of the drawing. The cams 2*c* extend in the longitudinal direction of the locking member 2*b*, slope downwards in the locking direction L, are separated with a lead-in space 2*d* for an engagement member, described in greater detail below. The locking member holder 2*a* also has a first inner transverse surface 2*p*, which is substantially vertical and orientated substantially perpendicularly to the locking direction L, as well as, situated at the higher ends of the cams 2*c*, a second inner transverse surface 2*e*, situated at the lower ends of the cams 2*c*, an upper, inner surface 2*m*, and two substantially vertical inner side surfaces 2*r*, see FIG. 2. The width of the locking member 2*b* and the internal width of the locking member holder 2*a*, i.e. the distance between the inner side surfaces 2*r*, is adapted such that a small play is present between the locking member 2*b* and the side surfaces 2*r*, which play is sufficient for the locking member 2*b* to be able without significant friction resistance to perform a movement, described in greater detail below, in a vertical plane lying perpendicular to the cross section in FIG. 2. The dimensions of the locking member 2*b*, and the distance between the inner side surfaces 2*r*, are further adapted such that the rotation of the locking member 2*b* about a vertical axis, the rotation thereof about a horizontal axis lying parallel with the locking direction L, and the horizontal movement thereof perpendicular to the locking direction L, apart from the movement which is granted by the said play, are prevented. The locking member holder 2*a* thus has an inner holder space 2*x*, which is delimited by the supporting surfaces 2*c*, the first inner transverse surface 2*p*, the second inner transverse surface 2*e*, the upper, inner surface 2*m*, and the inner side surfaces 2*r*.

The distance between the first inner transverse surface 2*p* and the second inner transverse surface 2*e* is preferably sufficiently large so as not to impede the rotation of the locking member 2*b* about an imaginary axis lying horizontal and perpendicular to the locking direction L. On the other hand, the distance between the first inner transverse surface 2*p* and the second inner transverse surface 2*e* is sufficiently small for the movement of the locking member 2*b* between an unloaded locking position (see below with reference to FIG. 3*a*) and a blocking position (see below with reference to FIG. 4) to be limited.

It should be pointed out that, in an alternative embodiment, a part of the locking member 2*b* can slide down between the supporting surfaces 2*c*. The locking member is situated in the holder space 2*x*, and the movement of the locking member 2*b*, as a result of its external shape, especially its width, and the shape of the holder space 2*x*, especially its width, is limited such that the movement of its centre of gravity (CG) is substantially limited to an at least partially upwardly or downwardly directed movement in a motional plane lying vertical and parallel with the locking direction L. In addition, the positions of the first inner transverse surface 2*p* and the upper, inner surface 2*m* are adapted such that the locking member 2*b* bears against these in the event of an opening attempt and is not then forced away but remains in the blocking position (see below with reference to FIG. 4). Moreover, the distance between the upper, inner surface 2*m* and the supporting surfaces 2*c* is limited such that the locking member 2*b* cannot rotate to the degree that its ends change place, i.e. so that the locking member does not "flip" round.

The locking member 2*b*, under the influence of solely the gravitational force and in the absence of the engagement member 4*a*, assumes a locking position shown in FIG. 1, whereupon it bears against the cams 2*c* and the second inner transverse surface 2*e*, so that a longitudinal axis LL of the locking member (marked in FIG. 1 with a dashed line) is angled downwards in the locking direction, and a bottom surface 2*f* on the locking member 2*b* is angled such that it is facing partially in a direction opposite to the locking direction L and, between the cams 2*c*, is exposed in the direction of the lead-in space 2*d*. The locking member holder 2*a* has an outer opening 2*g* and an inner opening 2*h*, which, viewed from inside the locking member holder 2*a*, open in a direction opposite to the locking direction L and in the locking direction L, respectively. In other words, the outer opening 2*g* and the inner opening 2*h* are situated at the higher and lower ends, respectively, of the cams 2*c*.

The engagement member of the second locking part 4 comprises an actuating part 4*b*, in the form of an upwardly directed protrusion 4*b*, which is arranged, in an imaginary path lying parallel with the locking direction L, to be led into the locking member holder 2*a* through the outer opening 2*g*. The protrusion 4*b* has a first surface region 4*f* on the highest situated part of the protrusion 4*b* and a second surface region 4*g*. When the engagement member moves parallel with the locking direction L, the first surface region 4*f* is situated, in relation to the second surface region 4*g*, in the locking direction L farther away from and in a vertical direction closer to the centre of gravity CG of the locking member.

In the locking position of the locking member 2*b*, a part of the locking member 2*b*, which part is here referred to as the contact part 2*y*, is situated in the path of the protrusion 4*b*. The demarcation for the contact part 2*y*, and the path of the protrusion 4*b*, is marked in FIG. 1 and FIG. 2 with a dashed line KL. The contact part 2*y* is therefore defined at least partially by the relation of the locking member 2*b* to the locking member holder 2*a* and the engagement member 4*a*. More precisely, the contact part 2*y* is that part of the locking member 2*b* which, in the locking position of the locking member 2*b*, is located in the path of the actuating part 4*b*.

Figure 2A:
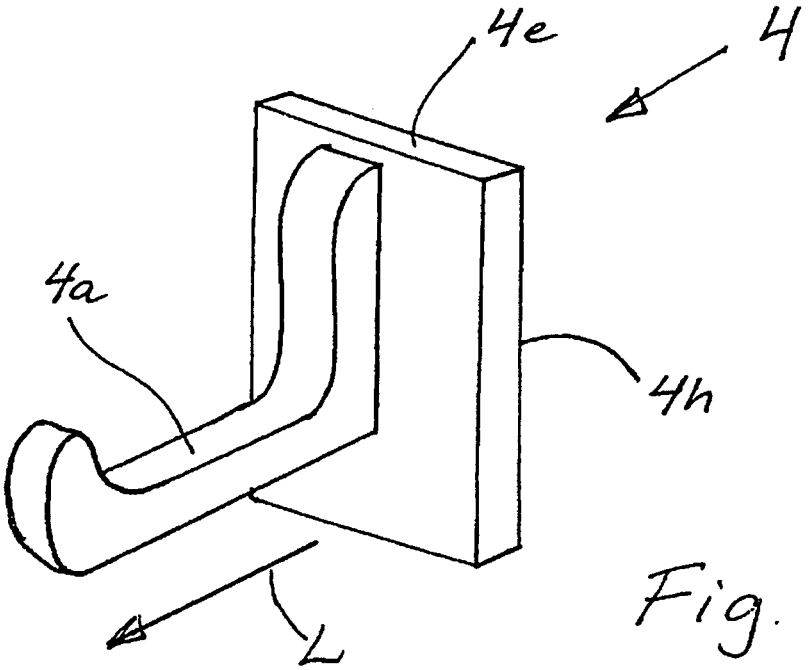

FIG. 2*a* shows a perspective view of the second locking part 4, which has a flat-shaped fixing part 4*e* that on a rear side 4*h* has an adhesive surface produced with the abovementioned tape and coated with a protective film which is removed prior to fixing on the element, for example the door. The engagement member 4*a* protrudes from a central portion of the fixing part 4*e* and therefore has a free end. The central position of the engagement member 4*a* on the fixing part 4*e*, in the fitted state of the second locking part 4, minimizes bending loads in the adhesive surface in the event of tensile stresses in the engagement member 4*a*.

Figure 2B:
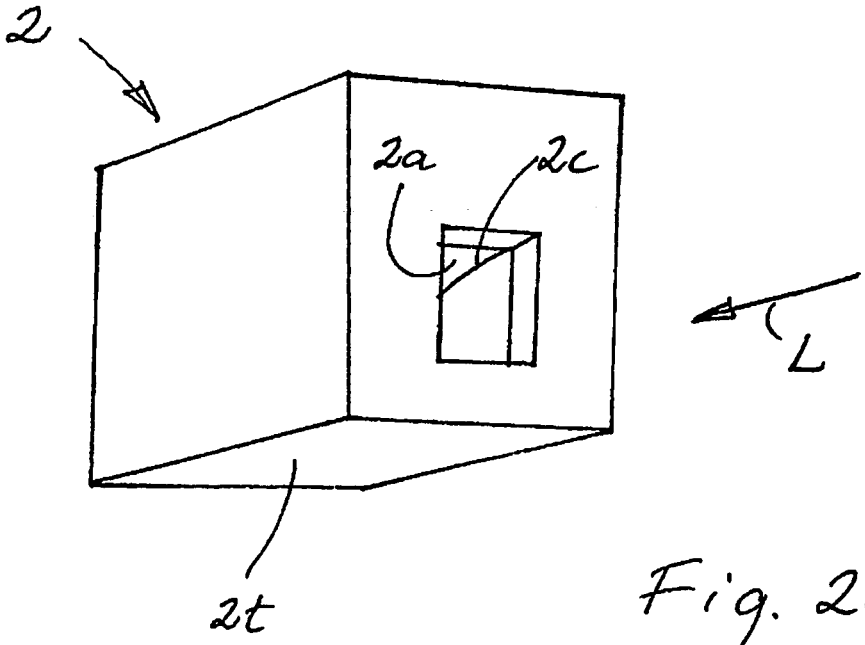

FIG. 2*b* shows a perspective view of the first locking part 2, which has a bottom surface 2*t* on which an adhesive surface is produced with the abovementioned tape, which adhesive surface is coated with a protective film which is removed prior to fixing on the element, for example the cupboard.

Figure 3:
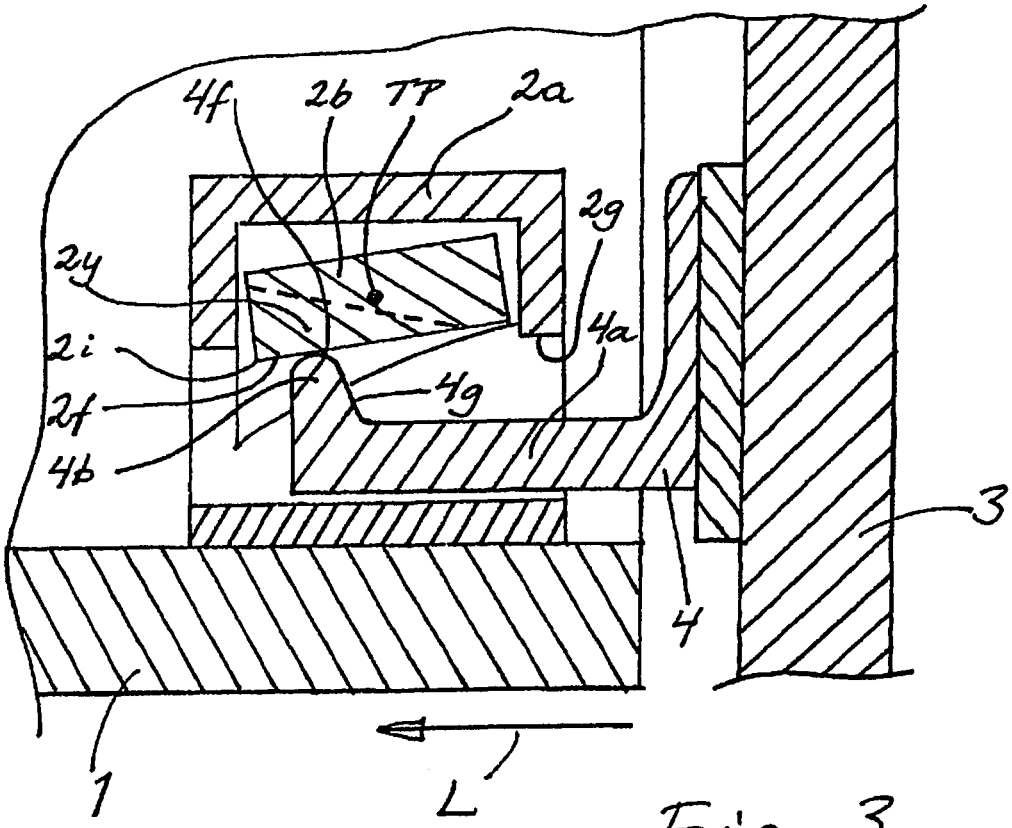

FIG. 3 shows that the engagement member 4*a* is elongated and, at least in the vicinity of the closed position of the second element 3, is orientated in the locking direction L. When the engagement member 4*a* moves in the locking direction L, the first surface region 4*f* passes the contact part 2*y* of the locking member 2*b*, whereupon the protruding member 4*b* comes into contact with the contact part 2*y* such that the centre of gravity CG of the locking member 2*b* is displaced at least partially upwards, i.e. the centre of gravity CG has an upwardly directed motional component. More precisely, when the protrusion 4*b* is led into the first locking part 2 and through the lead-in space 2*d*, it comes into contact with the bottom surface 2*f* of the locking member 2*b*. While the second element 3 is being led towards the closed position, the protrusion 4*b* moves beneath the locking member 2*b* towards a bottom edge 2*i* situated on that end of the locking member 2*b* which is facing in the locking direction L, whereupon the locking member is at least partially forced upwards by the engagement member. More precisely, the protrusion 4*b* displaces upwards that end of the locking member 2*b* which is facing in the locking direction L, so that the locking element 2*b* rotates about an imaginary axis which is horizontal and perpendicular to the locking direction L.

Figure 3A:
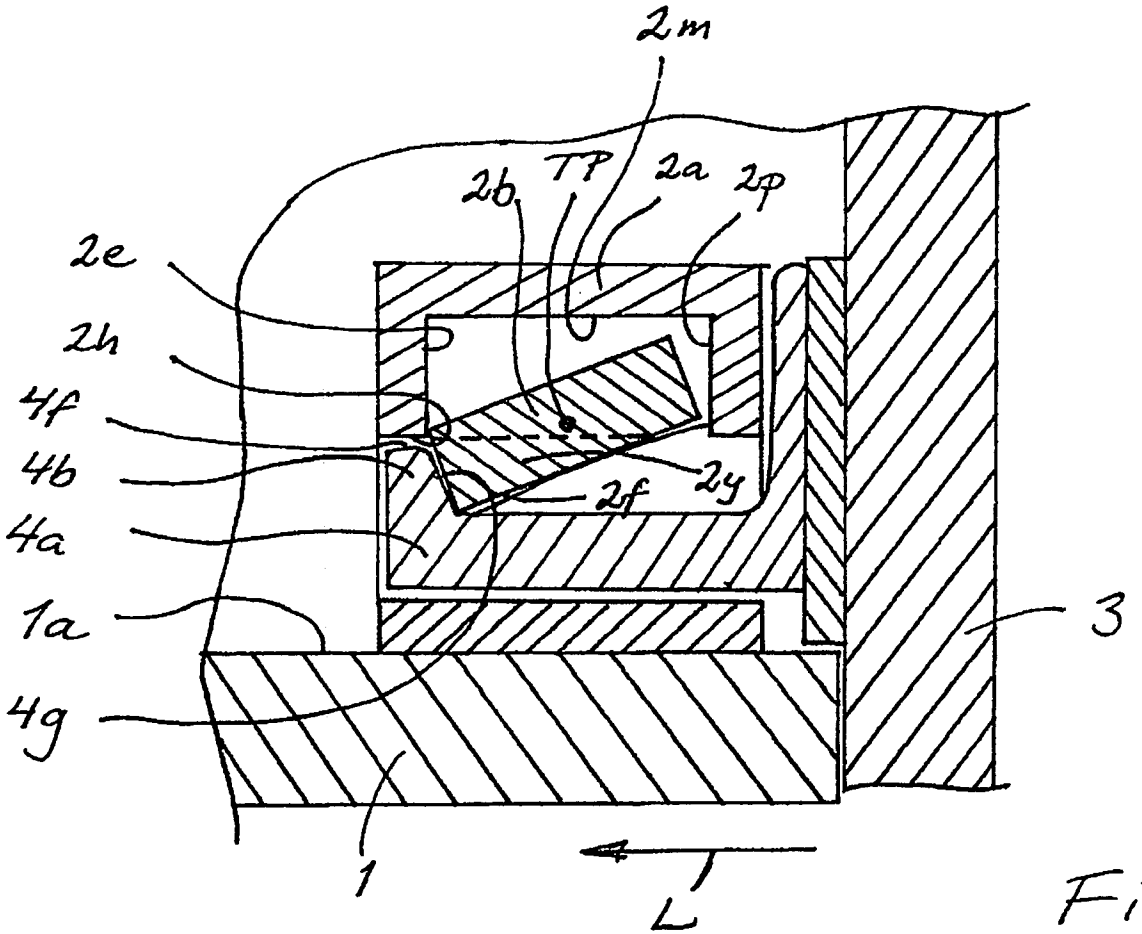

Here reference is made to FIG. 3*a*. Once the first surface region 4*f* has passed the contact part 2*y*, the locking member moves towards the locking position, owing to gravitational influence and the position of the second surface region 4*g*, in relation to the first surface region 4*f*, farther away in a vertical direction from the centre of gravity CG of the locking member. More precisely, once the protrusion 4*b*, with the second element 3 in the closed position, has passed the inner, bottom edge 2*i* (FIG. 3), the locking member 2*b* returns towards the locking position under the influence of solely gravitational force, so as to assume the locking position. As it moves towards the locking position, the locking member 2*b* rotates back about an imaginary axis which is horizontal and perpendicular to the locking direction L, so that its end facing in the locking direction L at least partially ends up at a lower level than an upper portion of the engagement member 4*a*, i.e. an upper portion of the protrusion 4*b*. The protrusion 4*b* is in this case situated farther away in the locking direction L than the locking member 2*b*. In the locking position, the locking member 2*b*, when no opening force, i.e. a force which acts upon the second locking part 2 and is directed oppositely to the locking direction L, is present on the locking device, is in contact with the supporting surfaces 2*c*, the second inner transverse surface 2*e* and possibly with the engagement member 4*a*. In this embodiment and in this position, however, the locking member 2*b*, if no opening force is present, has no contact with the first inner transverse surface 2*p* and the upper, inner surface 2*m*.

Figure 4:
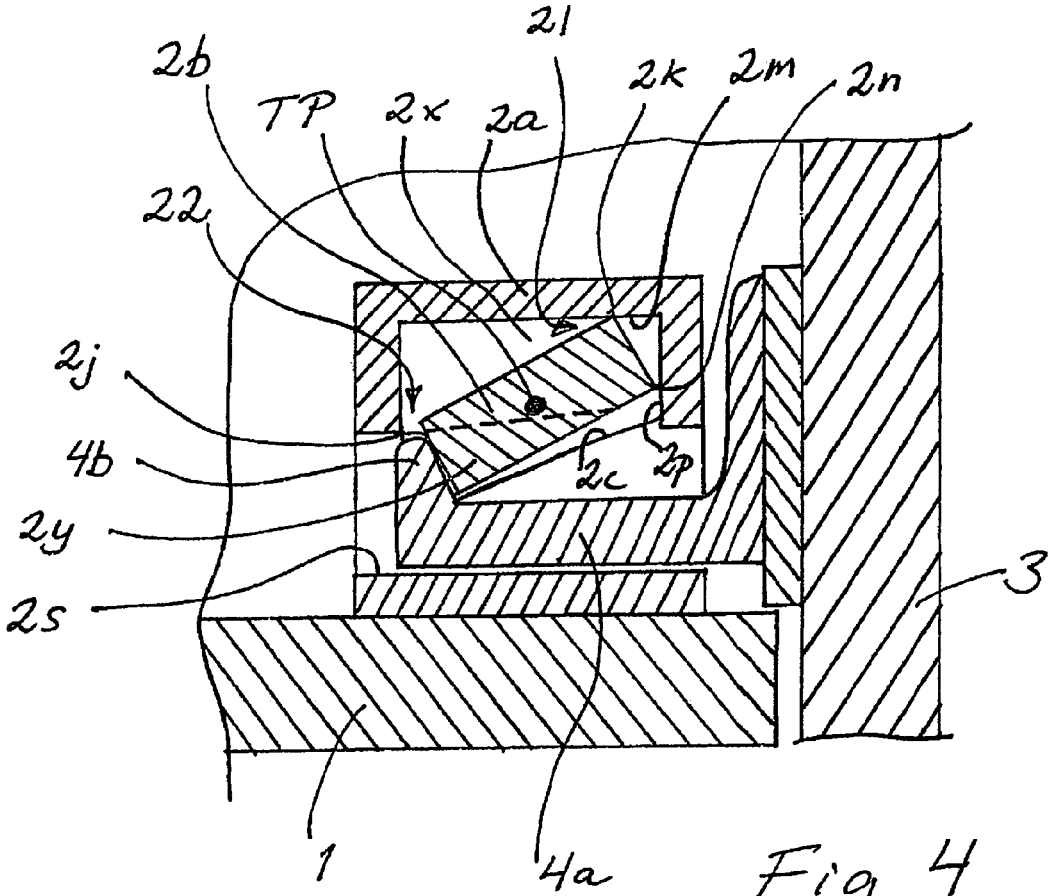

Here reference is made to FIG. 4. In the case of a force directed opposite to the locking direction L and acting upon the second locking part 2, the locking member 2*b* in the locking position is arranged, through bearing contact in a first contact region 21 against the upper, inner surface 2*m* and the first inner transverse surface 2*p* of the holder space 2*x*, as well as bearing contact in a second contact region 22 against the protrusion 4*b*, the second contact region 22 lying farther away in the locking direction L than the first contact region 21, to prevent movement of the second locking part 4 in a direction opposite to the locking direction L. The locking member, as a result of lying wedged between the upper, inner surface 2*m* and the first inner transverse surface 2*p* of the holder space 2*x* and the protrusion 4*b*, therefore prevents movement of the second locking part 4 in a direction opposite to the locking direction L. More precisely, the locking member 2*b* has at an end facing in a direction opposite to the locking direction L, an upper, outer edge 2*k* and a lower, outer edge 2*n*. The movement of the second locking part 4 in a direction opposite to the locking direction L is herein prevented owing to the bearing contact of the locking member 2*b*, with an inner surface 2*j*, against the protrusion 4*b*, the bearing contact of the locking member 2*b*, with the upper, outer edge 2*k*, against the upper, inner surface 2*m*, and the bearing contact of the locking member 2*b*, with the lower, outer edge 2*n*, against the first inner transverse surface 2*p*, the region of the bearing contact against the protrusion 4*b* lying farther away in the locking direction than the region of the bearing contact against the upper, inner surface 2*m*, and against the first inner transverse surface 2*p*. The position in FIG. 4 is here also referred to as the blocking position and contact can in this case be present between the locking member and the supporting surfaces 2*c*.

It should be noted that the configuration of the actuating part 4*b* should be such that the locking member 2*b*, in the locking position, cannot slide off the actuating part. More precisely, the second surface region 4*g* should be sufficiently steep to prevent the locking member 2*b* from sliding off. More generally, the inclination on the second surface region 4*g* is matched to the inclination of the locking member 2*b* to prevent the locking member 2*b* from sliding off in the event of an opening force. In addition, the distance between a lower side of the engagement member 4*a* and a lower, inner surface 2*s* in the locking member holder 2*a* is so small that a downward bending of the engagement member 4*a* when the same is subjected to load is prevented by contact with the said lower, inner surface 2*s*. This means reduced demands upon the flexural rigidity of the engagement member 4*a*, which simplifies the construction.

Figure 5:
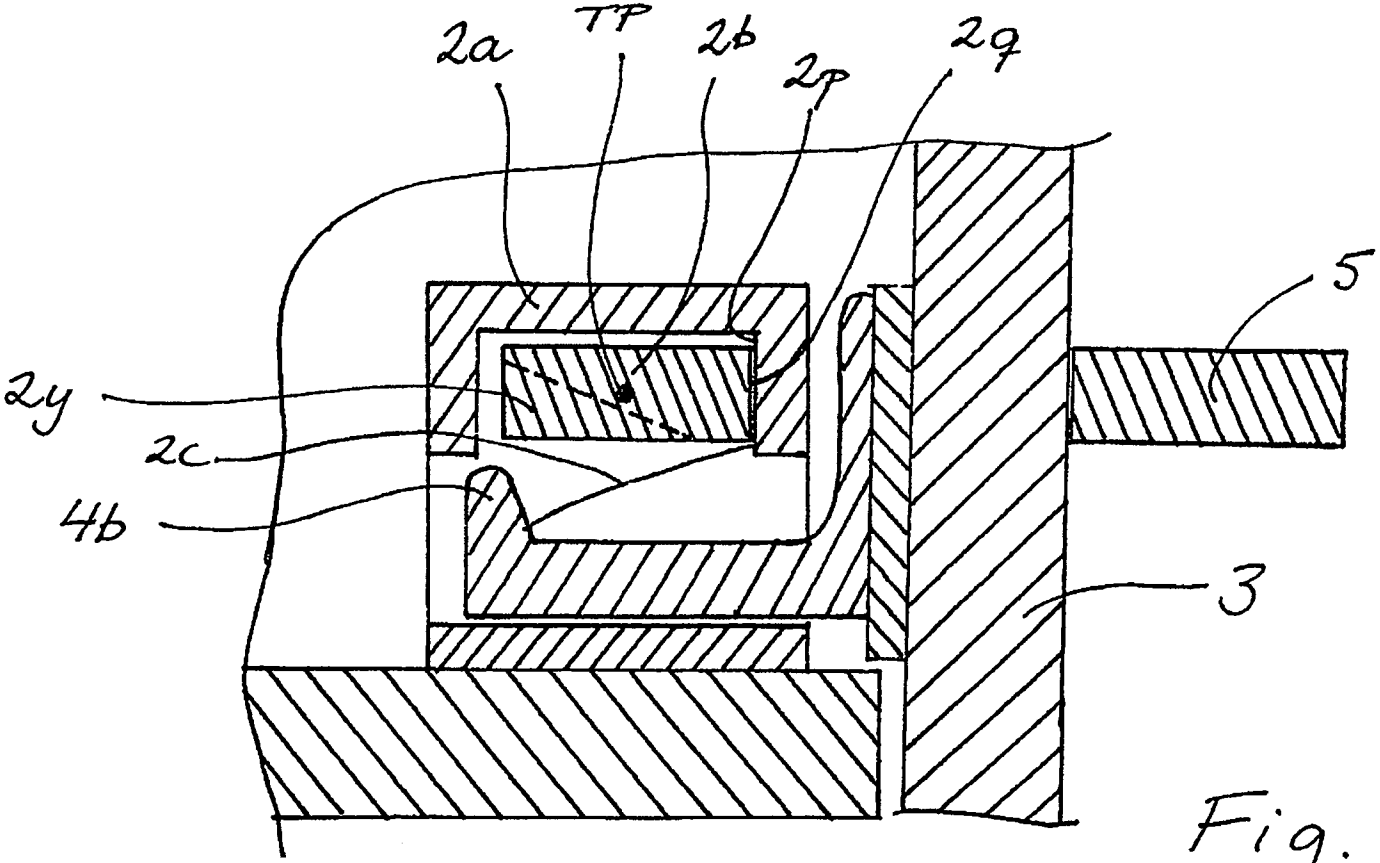
FIG. 5 shows a cross-sectional view corresponding to that in FIG. 3*a*, with an additional activation member for controlling the locking device.

Here reference is made to FIG. 5. When an activating member 5, in the form of a permanent magnet 5, is installed outside the second element 3 (the door) in the vicinity of the locking device, a magnetic force is created which attracts the locking member 2*b* towards the activating member 5. Here, the magnet 5 forming the activating member 5, and the permanent magnet of the locking member 2*b*, are orientated with the poles in the same direction, so that an attraction force is created. Under the influence of the magnetic force, the locking member 2*b* rotates about an imaginary horizontal axis which is perpendicular to the locking direction L, and assumes an opening position in which an outer surface 2*q* of the locking member 2*b*, facing in a direction opposite to the locking direction L, bears against the substantially perpendicular first transverse surface 2*p* of the locking member holder 2*a*. The locking member 2*b* is here in a higher position than the protrusion 4*b*, so that the protrusion 4*b*, in the event of an opening relative movement between the elements 1, 3 from the closed position, can move in a direction opposite to the locking direction L past the locking member 2*b*. In order to facilitate the said rotation of the locking member 2*b* under the influence of magnetic force, it is important, when unlocking, to avoid applying an opening force to the locking device.

It should be noted that, where the locking member 2*b* comprises a permanent magnet, then the activating member 5 can alternatively comprise a temporary magnet. Conversely, the locking member 2*b* can comprise a temporary magnet and the activating member 5 can comprise a permanent magnet. As a further alternative, the activating member can be an electromagnet.

Figure 5A:
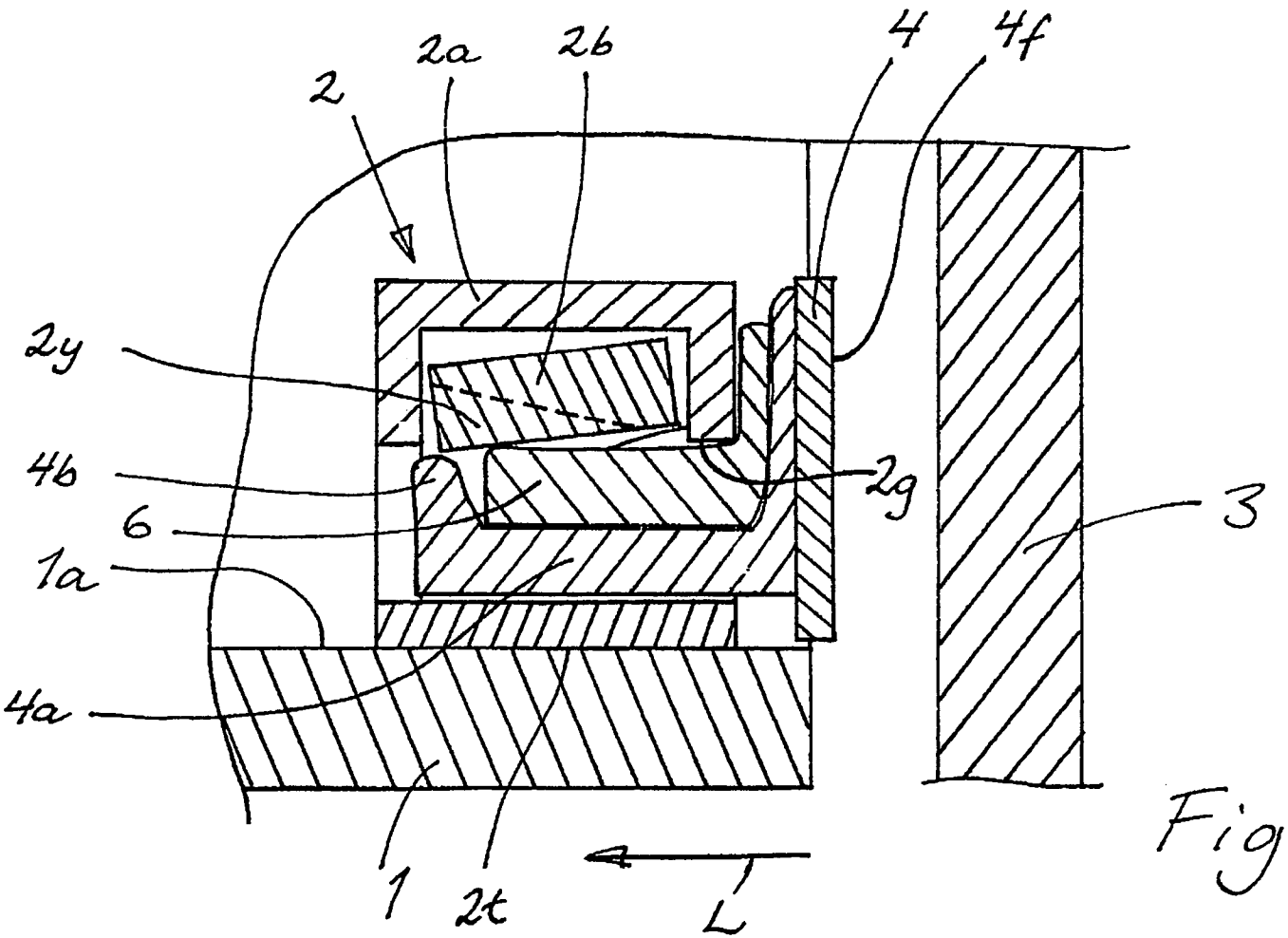
FIG. 5*a* shows a cross-sectional view, corresponding to that in FIG. 1, of the locking device during its fitting.

FIG. 5*a* shows the locking device with an assembly tool 6 for fitting the first and the second locking part 2, 4 to the first and second element 1, 3 respectively. The assembly member 6 is arranged to be detachably connected to the second locking part 4, so that at least a part of the assembly tool 6 is situated on the top side of the engagement member 4*a*. A top surface on part of the assembly tool which is intended to be inserted through the opening 2*g* in the locking member holder 2*a* is here located level with or above the actuating part 4*b*. Moreover, the assembly tool 6 has a portion which, in the inserted state of the engagement member, extends outside the locking member holder 2*a* and above the opening 2*g*. The assembly tool 6 can also comprise a part (not shown in FIG. 5*a*) which is situated beneath the engagement member 4*a* and which adjusts the vertical position of the second locking part 4 in relation to the first locking part 2. In addition, the assembly tool can comprise means, for example in the form of distancing parts, for correctly positioning the second locking part 4 in the lateral direction of the first locking part 2.

In the course of assembly, or already during factory production, the assembly tool 6 is applied to the second locking part 4, and the engagement member 4*a* is then led into the second locking part to a position in which the locking member 2*b*, in the fitted state of the locking device, can assume the locking position to prevent movement of the second locking part 4 in a direction opposite to the locking direction L. That portion of the assembly tool 6 which, in the inserted state of the engagement member, extends outside the locking member holder 2*a* and above the opening 2*g*, ensures, by means of contact bearing against the outside of the locking member holder 2*a*, that the engagement member 4*a* is not pushed in too far, but is instead placed in a desired position in the locking direction L. Moreover, the assembly tool pushes the contact part 2*y* of the locking member 2*b* upwards and, through bearing contact against the locking member 2*b*, prevents the contact part 2*y* from moving into the path of the actuating part 4*b*.

After this, the locking device assembled with the aid of the assembly tool is placed on the upward-facing surface 1*a* in the first element, approximately in the desired position, though somewhat displaced in a direction opposite to the locking direction L. During this placement, the thin protective film remains over the tape on both the bottom surface 2*t* of the first locking part 2 and the rear side of the second locking part 4 (cf. FIG. 2*a*). Then the second element 3 is moved carefully into the closed position, i.e. the position in which the locking effect is to act, whereupon the locking device assembled with the aid of the assembly tool is moved somewhat in the locking direction after contact has occurred between the flat surface of the second element 3 and the flat rear side 4*h* of the second locking part 4. The second element 3 is thereafter moved carefully in a direction opposite to the locking direction L. After this, the position of the locking part 2 is suitably marked (for example with a pen on the upward-facing surface 1*a* or with a special configuration of the tape on the upward-facing surface 1*a*), the protective film is removed from its adhesive surface, and the first locking part 2 is fixed in the marked position. After this, the protective film on the rear side 4*h* of the second locking part 4 is removed (cf. FIG. 2*a*) and the second locking part 4 is moved about 2 mm out of the first locking part 2 in a direction opposite to the locking direction L. Then, the second element 3 is moved to the closed position, whereupon the second locking part 4 gets jammed on the second element 3 and remains there when the second element 3 is moved in a direction opposite to the locking direction L. After this, the assembly tool is removed, the tape is subjected to extra pressure for good adhesion and the fitting is complete (after possible bonding agent hardening according to the instructions of the manufacturer).

The assembly tool 6 therefore provides an opportunity to fit the locking device in a very simple and quick manner.

Figure 6:
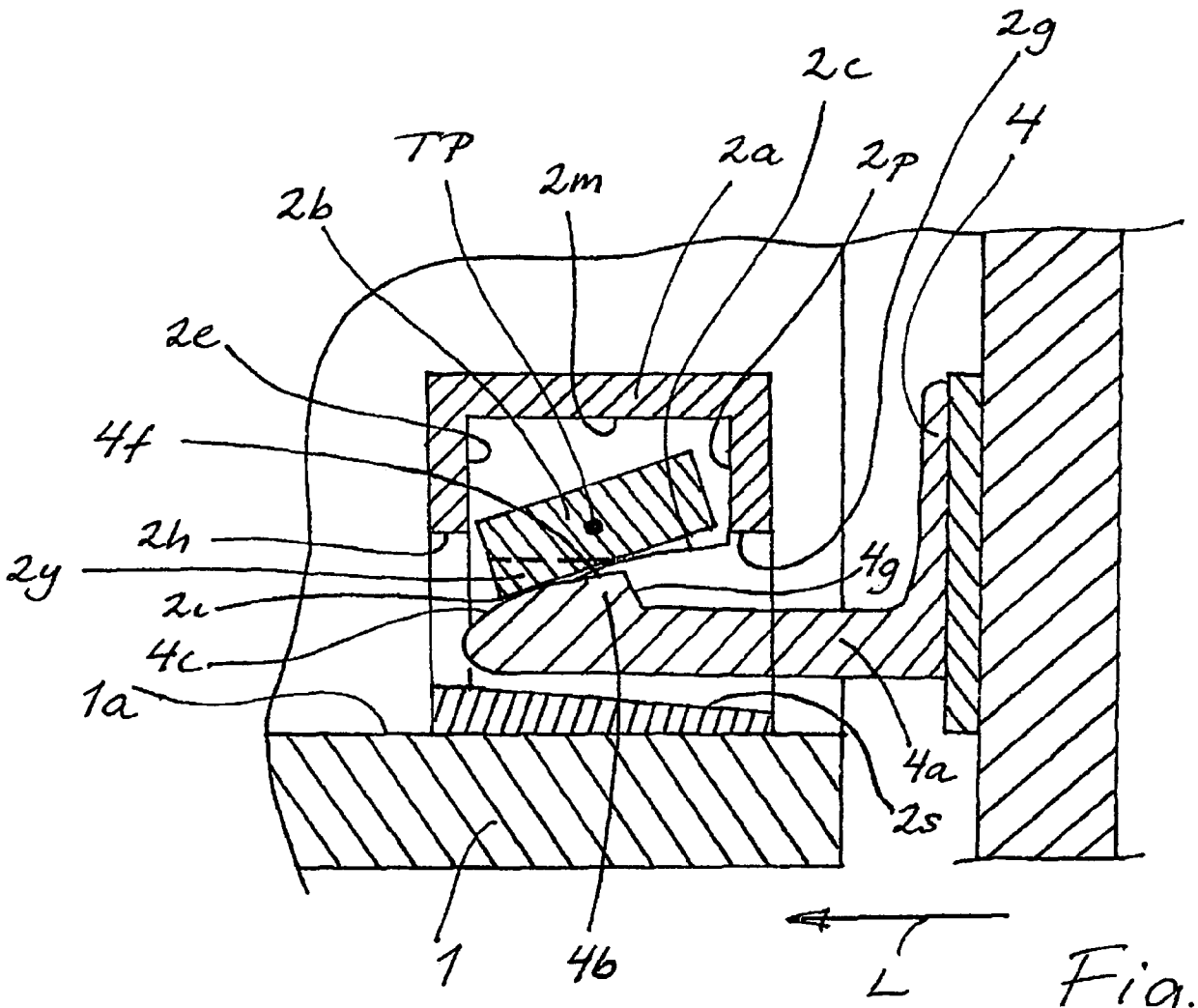
FIGS. 6, 7, 9, 10 and 11 show cross-sectional views of alternative embodiments of the locking device.

FIG. 6 shows an alternative embodiment of the locking device, conforming to the embodiment in FIG. 1-5, with the exception of the following:

A free end of the engagement member 4*a*, comprising the protrusion 4*b*, is shaped with a rounded top surface 4*c*, which slopes downwards in the locking direction L. The top surface 4*c* of the engagement member 4*a* is configured such that, while the second locking part 4 is moving in the locking direction L, the first contact between the engagement member 4*a* and the locking member 2*b* takes place at the bottom edge 2*i*, which is situated on that end of the locking member 2*b* which faces in the locking direction L, after which the protrusion 4*b* displaces upwards that end of the locking member 2*b* which faces in the locking direction L, so that the locking element 2*b* rotates about an imaginary axis horizontal and perpendicular to the locking direction L, contact being maintained between the bottom edge 2*i* of the locking member 2*b* and the top surface 4*c* of the engagement member 4*a*. One advantage with the top surface 4*c* is that the locking member 2*b* is actuated at a relatively far distance from its centre of gravity, which prevents tendencies to an initial translational movement of the locking member in the upward direction, which, in turn, eliminates the risk of a "chest drawer effect" when the locking member 2*b* is displaced, i.e. the top surface 4*c* produces a very favourable force action, which further reduces the friction forces between the locking member 2*b* and its holder 2*a*.

The embodiment in FIG. 6 also has a lower, inner surface 2*s* in the locking member holder 2*a*, which slopes gently upwards in the locking direction L. This allows the outer opening 2*g* to be made larger, which, in turn, allows greater tolerance variances for the entry of the engagement member 4*a* into the locking member holder 2*a*. At the same time, the, in the locking direction L, more remote higher portion of the lower, inner surface 2*s*, by virtue of its vicinity to the engagement member 4*a*, prevents the latter, for example should a person attempt to pull the locking device apart when the locking member 2*b* is in the locking position, from being bent downwards such that it disengages from the locking member 2*b*.

In addition, the cams 2*c* in the embodiment in FIG. 6 are shaped such that their inclination decreases in a direction opposite to the locking direction L. This means that the locking member 2*b*, during at least a part of each of its rotation movements, is supported at a distance from its ends. This means, in turn, that the point of support for the locking member 2*b* in the course of rotation lies relatively close to its centre of gravity, which is an advantage when the locking member 2*b*, under the influence of the magnetic force, assumes its opening position, since the lever arm of the centre of gravity becomes shorter and the necessary magnetic force therefore becomes less.

Figure 7:
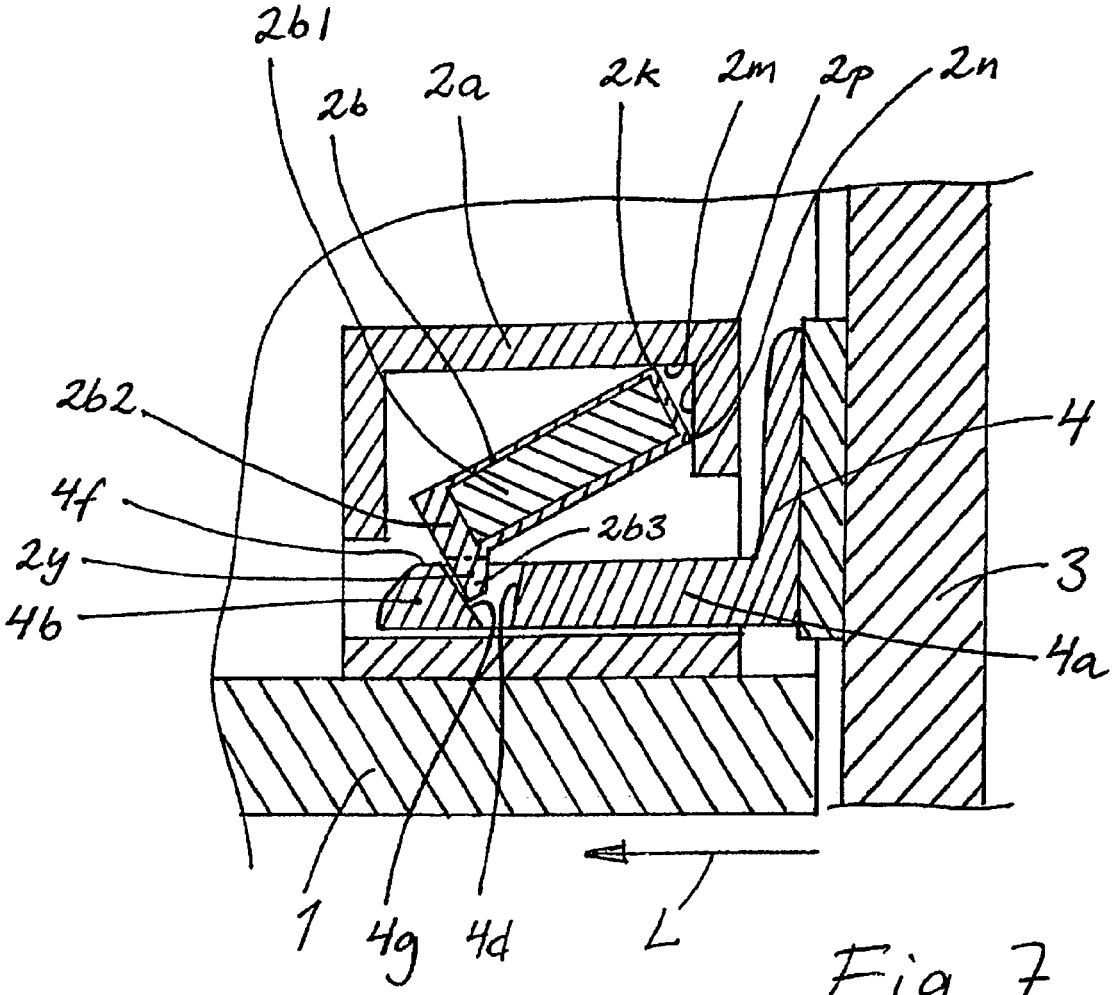

FIG. 7 shows a further alternative embodiment of the locking device, conforming to the embodiment in FIG. 1-5, with the exception of the following:

The locking member 2*b* comprises a somewhat elongated parallelepipedal permanent magnet 2*b*1, which is enclosed by a casing 2*b*2 made of a non-magnetic material, for example injection moulded plastic. On the casing 2*b*2 is formed a downwardly directed protrusion 2*b*3 having a contact part 2*y*, which contact part 2*y*, in a locking position of the locking member 2*b*, is located in the motional path of an actuating part 4*b*. The actuating part 4*b* is formed by a recess in the engagement member 4*a*. The actuating part has first surface region 4*f* and a second surface region 4*g*, the first surface region 4*f* being situated, in relation to the second surface region 4*g*, farther away in the locking direction L and farther away in a direction parallel with the movement of the contact part 2*y* out of the path of the actuating part 4*b*, which means that the contact part 2*y*, once the first surface region 4*f* in the locking direction has passed the contact part 2*y*, moves into the path of the actuating part 4*b*, i.e. the protrusion 2*b*3 moves at least partially into the recess 4*d*, and the locking member 2*b* assumes the locking position, whereby the movement of the second locking part 4 in a direction opposite to the locking direction L is prevented in a manner corresponding to that described above with reference to FIG. 4.

Figure 8:
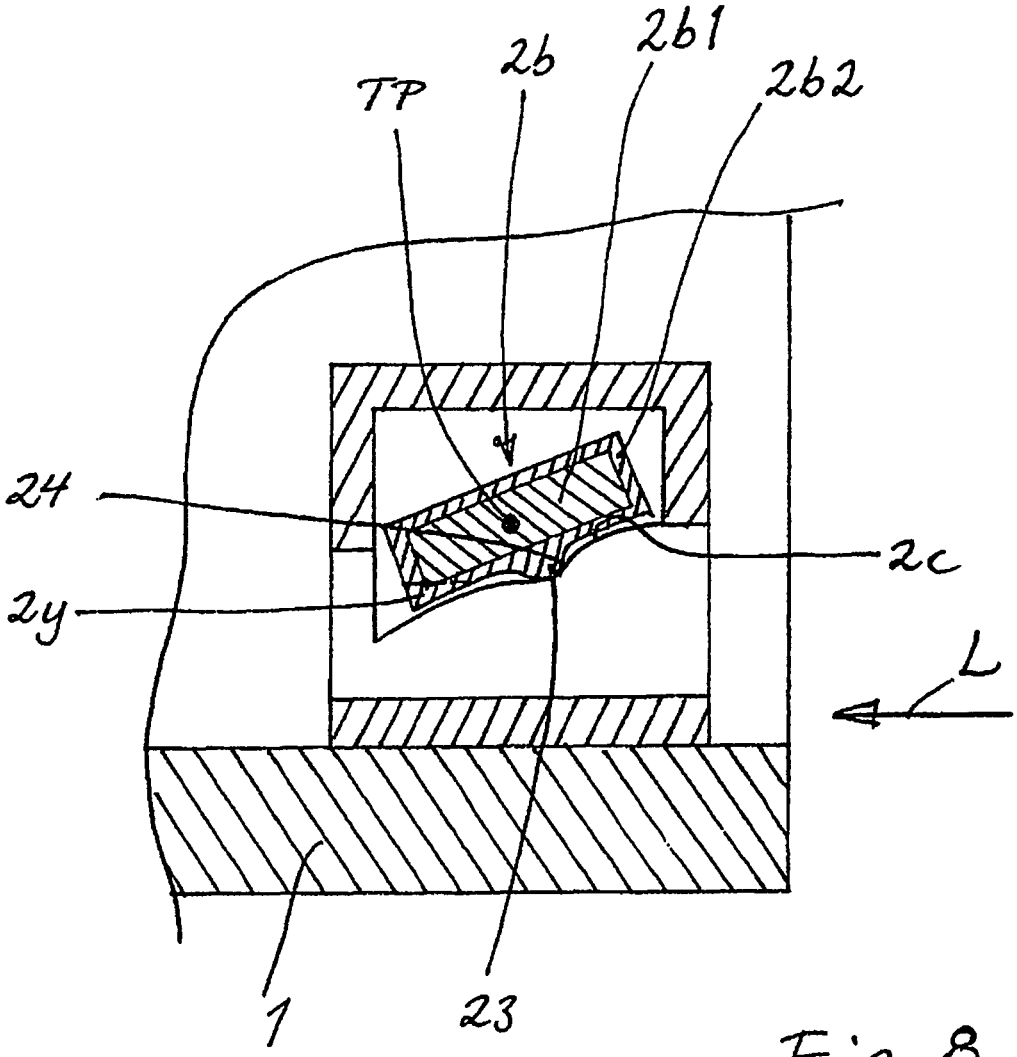
FIG. 8 shows a cross-sectional view of a part of a locking device according to a further alternative embodiment.

FIG. 8 shows another alternative embodiment of the locking device, conforming to the embodiment in FIG. 1-5, with the exception of the following:

The locking member 2*b* comprises a somewhat elongated parallelepipedal permanent magnet 2*b*1, which is enclosed by a casing 2*b*2 made of a non-magnetic material. On the lower side of the casing is formed a protrusion 23, which is arranged to extend into recesses 24 in the cams 2*c*, so that the locking member 2*b*, when rotating from the locking position to the opening position, is supported by the contact of the protrusion 23 with the recesses 24 in the cams. Since the protrusion 23 is situated relatively close to the centre of gravity CG, the moment which the magnetic force, in the opening position, has to surmount is relatively small. This means, in turn, that the demands upon the strength of the magnet(s) can be reduced. It should be pointed out that, in the event of an opening force, the protrusion 23 can be moved out of the recesses 24, so that a blocking position is present as described with reference to FIG. 4.

Figures 9A, 9B:
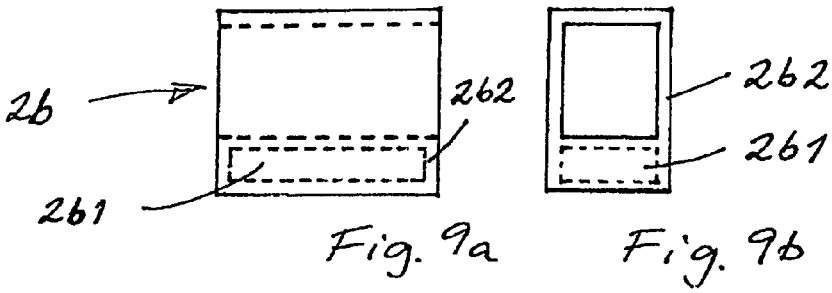
FIGS. 9*a* and 9*b* show a side view and front view, respectively, of a part of the locking device in FIG. 9.
Figure 9:
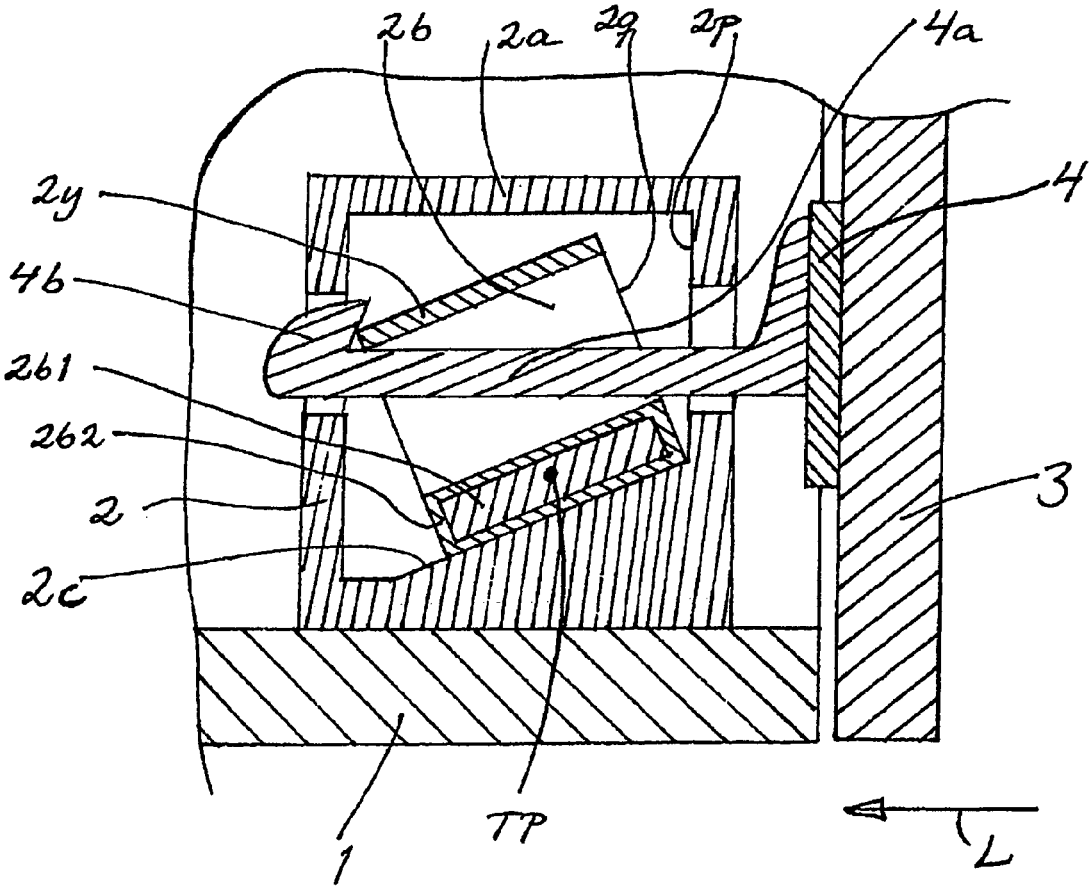

FIGS. 9, 9*a* and 9*b* show another embodiment of the locking device, having a first and a second locking part 2, 4 which are fitted to a first and a second element 1, 3 respectively. The first locking part 2 comprises a locking member 2*b*, which, in turn, comprises a somewhat elongated parallelepipedal permanent magnet 2*b*1, (in FIGS. 9*a* and 9*b* indicated with dashed lines), and a casing 2*b*2 made of a non-magnetic material, which partly encloses the permanent magnet 2*b*1 and moreover, above the permanent magnet, forms a short tube through which an actuating part 4*b* belonging to an engagement member 4*a* of the second locking part 4 can move. The locking member 2*b* comprises a contact part 2*y*, which, in the locking position and the opening position, is situated respectively in and outside the path of the actuating part 4*b*. The centre of gravity CG of the locking member is located beneath the actuating part 4*b* and the contact part 2*y*.

The locking member 2*b* is situated in a locking member holder 2*a* and, in the locking position, is arranged to be supported against a supporting surface 2*c* which slopes downwards in the locking direction. When an activating member (cf. FIG. 5), in the form of a permanent magnet, is installed outside the second element 3 in the vicinity of the locking device, a magnetic force is created which attracts the locking member 2*b* towards the activating member. Under the influence of the magnetic force, the locking member 2*b* rotates about an imaginary horizontal axis which is perpendicular to the locking direction L, and assumes an opening position in which an outer surface 2*q* of the locking member 2*b*, facing in a direction opposite to the locking direction L, bears against a substantially perpendicular first transverse surface 2*p* of the locking member holder 2*a*. The contact part 2*y* is here located outside the path of the actuating part 4*b*, so that the actuating part 4*b*, in the event of an opening relative movement between the elements 1, 3 from the closed position, can move in a direction opposite to the locking direction L past the locking member 2*b*.

Figure 10:
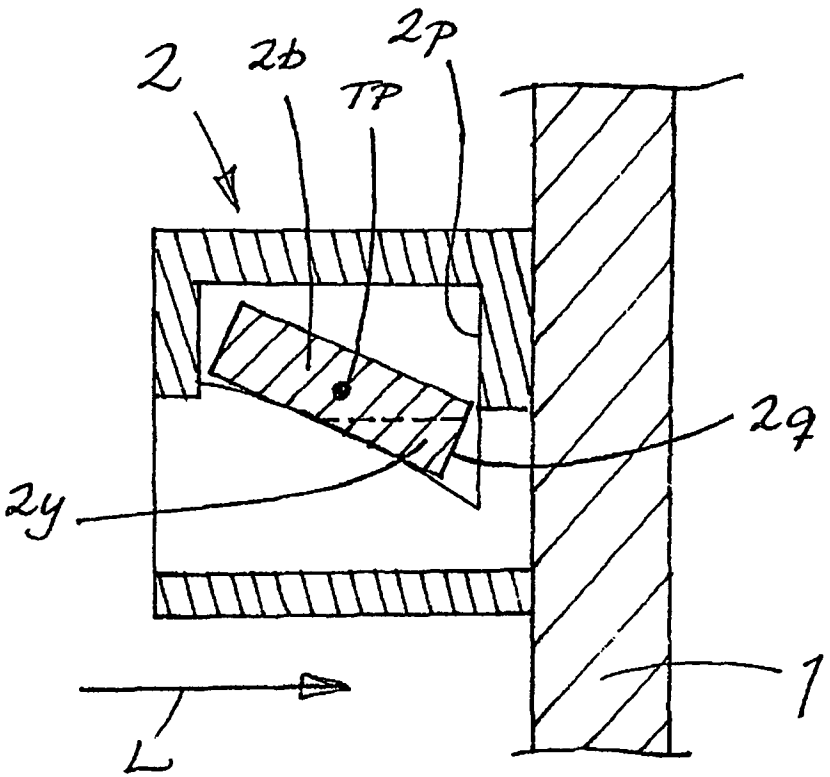
Figure 10:
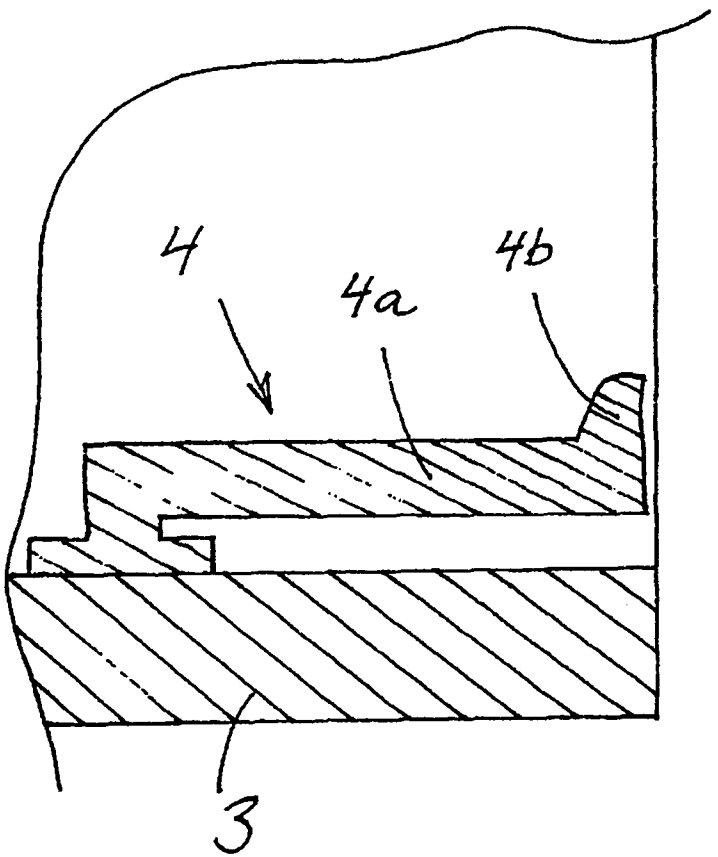

FIG. 10 shows another embodiment of the locking device, having a first and a second locking part 2, 4 which are fitted to a first and a second element 1, 3 respectively.

In this case, the first element is a door 1 and the second element is a cupboard 3. Even though the cupboard 3 does not perform any movement in relation to the surroundings, according to the definition of the locking direction L which is adopted in this representation the second locking part 4, at least in the vicinity of the first locking part 2, when the locking parts 2, 4 are brought together, moves in relation to the first locking part 2 in a locking direction L. The locking parts 2, 4 per se are configured substantially the same as in the embodiment described with reference to FIG. 1-5, with the difference that the magnetic force which is created upon the installation of an activating member (cf. FIG. 5) in the form of a permanent magnet, is directed parallel with the locking direction L. More precisely, if the activating member is installed outside the first element 1 in the vicinity of the locking device, a magnetic force is created which attracts the locking member 2*b* towards the activating member. Under the influence of the magnetic force, the locking member 2*b* rotates about an imaginary horizontal axis which is perpendicular to the locking direction L, and assumes an opening position in which an outer surface 2*q* of the locking member 2*b*, facing in the locking direction L, bears against a substantially perpendicular first transverse surface 2*p* of the locking member holder 2*a*. In this case, a contact part 2*y* of the locking member 2*b* is located outside the path for an actuating part 4*b* of an engagement member 4*a* belonging to the second locking part 4, so that the actuating part 4*b*, in the event of an opening relative movement between the elements 1, 3 from the closed position, can move in a direction opposite to the locking direction L past the locking member 2*b*.

Figure 11:
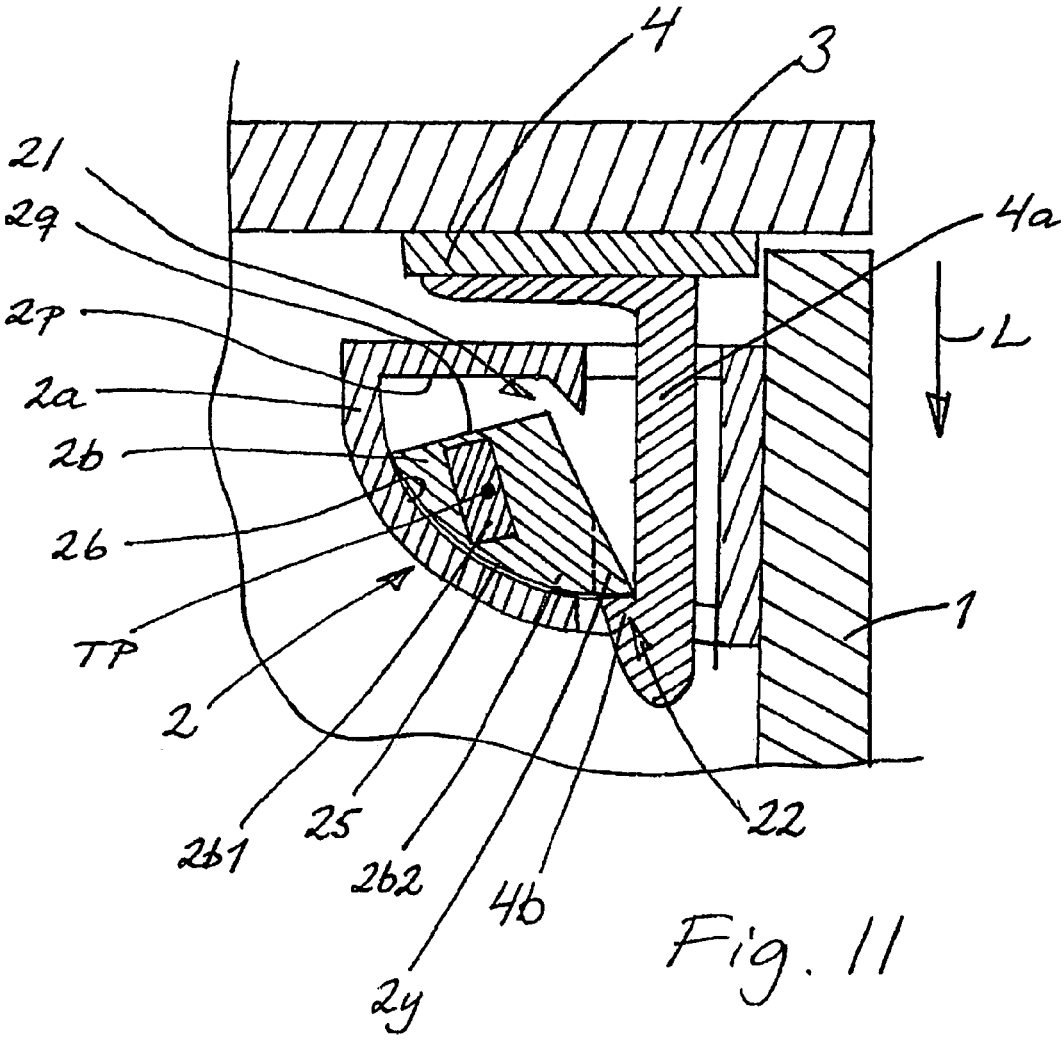

FIG. 11 shows a further embodiment of the locking device, having a first and a second locking part 2, 4 which are fitted to a first and a second element 1, 3 respectively. In a locking manoeuvre, the second locking part 4 moves in relation to the first locking part 2 in a locking direction L which is not horizontal but vertical and downwardly directed. The first locking part 2 comprises a locking member 2*b*, which, in turn, comprises a somewhat elongated parallelepipedal permanent magnet 2*b*1 and a casing 2*b*2 made of a non-magnetic material, which encloses the permanent magnet 2*b*1. The locking member 2*b* comprises a contact part 2*y*, which, in a locking position and an opening position, is situated respectively in and outside the path of an actuating part 4*b* of an engagement member 4*a* belonging to the second locking part 4. The centre of gravity CG of the locking member is in the opening position in a higher position than in the locking position. It should be pointed out that the embodiment in FIG. 11 comprises means, for example in the form of a stop lug, etc. (not shown), which prevents the locking member 2*b*, in the absence of the engagement member 4*a*, from moving too far into the path of the engagement member.

The first locking part 2 comprises a locking member holder 2*a*, in which the locking member 2*b* is situated. The locking member 2*b* has a convex surface 25, which is matched to a concave inner surface 26 in the locking member holder 2*a*, which surfaces are configured and orientated such that the locking member 2*b*, under solely gravitational influence, moves towards the locking position. In the locking position, the locking member 2*b*, through bearing contact in a first contact region 21 against the locking member holder 2*a* and bearing contact in a second contact region 22 against the actuating part 4*b*, which second contact region 22 lies farther away in the locking direction L than the first contact region 21, prevents movement of the second locking part 4 in a direction opposite to the locking direction L.

When an activating member (cf. FIG. 5), in the form of a permanent magnet, is installed outside the second element 3 in the vicinity of the locking device, a magnetic force is created which attracts the locking member 2*b* towards the activating member. Under the influence of the magnetic force, the locking member 2*b* moves under rotation about an imaginary horizontal axis which is perpendicular to the locking direction L, and assumes an opening position in which an outer surface 2*q* of the locking member 2*b*, facing in a direction opposite to the locking direction L, bears against a substantially horizontal first transverse surface 2*p* of the locking member holder 2*a*. The contact part 2*y* is here located outside the path of the actuating part 4*b*, so that the actuating part 4*b*, in the event of an opening relative movement between the elements 1, 3 from the closed position, can move in a direction opposite to the locking direction L past the locking member 2*b*.

The invention claimed is:

1. A locking device comprising a first element, a second element, a first locking part fitted to said first element, and a second locking part fitted to said second element, wherein when said first and second locking parts are brought together said second locking part moves in relation to said first locking part in a locking direction (L), and wherein said first locking part comprises a locking member comprising a temporary magnet or a permanent magnet, and a contact portion, and a locking member holder arranged to support said locking member without said locking member being fixed to said locking member holder, said locking member being movable in relation to said locking member holder, said second locking part comprising an actuating part, whereby upon movement of said contact portion out of or into the path of said actuating part the center of gravity (CG) of said locking member moves at least partially upward and at least partially downward said locking device being arranged such that, upon moving said actuating part in said locking direction (L) past said contact portion, said contact portion moves into the path of said actuating part, and said locking member, through bearing contact against said locking member holder and against said actuating part, can prevent movement of said second locking part in a direction opposite to said locking direction (L), and a magnet for generating a magnetic field to act upon said temporary or permanent magnet, and move said contact portion out of the path of said actuating part.

2. A locking device according to claim 1, wherein when said second locking part is close to said first locking part, said locking direction (L) is substantially horizontal, and said actuating part is arranged to move beneath at least a part of said locking member.

3. A locking device according to claim 1, wherein when said second locking part is close to said first locking part, said locking direction (L) is substantially horizontal, and said actuating part is arranged to move beneath the center of gravity (CG) of said locking member.

4. A locking device according to claim 3, wherein said locking member is substantially parallelepipedal, and said first locking part is arranged such that said locking member is inclined when said contact portion is positioned in the path of said actuating part.

5. A locking device according to claim 4, wherein said locking member is provided in the form of a parallelepipedal elongated permanent magnet.

6. A locking device according to claim 2, wherein said first locking part includes at least one supporting surface, which at least partially slopes downwards in said locking direction (L), such that when said contact portion is positioned in the path of said actuating part, said locking member is supported by said supporting surface solely under the influence of gravitational force.

7. A locking device according to claim 1, wherein said locking member holder includes a substantially vertical first inner surface substantially perpendicular to said locking direction (L), and said locking member is arranged such that when a force generated by a magnetic field generated by said magnet acts upon said temporary or permanent magnet, said locking member bears against said substantially vertical first inner surface.

8. A locking device according to claim 1, comprising an assembly tool for fitting said first and said second locking parts to said first and second elements, said assembly tool arranged, through bearing contact against said locking member, to prevent said contact part from moving into the path of said actuating part.

9. A locking device according to claim 1, wherein said second locking part comprises an engagement member comprising said actuating part, said engagement member being elongated in the locking direction (L), whereby upon movement of said second locking part in a direction opposite to said locking direction (L) being prevented, said locking member holder, through contact with said engagement member, interferes with the bending of said engagement member in a direction away from said bearing contact of said locking member against said locking member holder.

* * * * *